United States Patent [19]

Harrington

[11] Patent Number: 4,867,720

[45] Date of Patent: Sep. 19, 1989

[54] SWIMMER'S PROPULSION ENHANCER AND TRAINING DEVICE AND METHOD

[75] Inventor: Marlin K. Harrington, Crawfordsville, Ind.

[73] Assignee: Harrington Products, Inc., Crawfordsville, Ind.

[21] Appl. No.: 297,398

[22] Filed: Jan. 17, 1989

Related U.S. Application Data

[63] Continuation-in-part of Ser. No. 72,416, Jul. 13, 1987.

[51] Int. Cl.[4] ..... A63B 31/06

[52] U.S. Cl. ..... 441/60; 441/61

[58] Field of Search ..... 441/55, 64; 434/254; 128/87 R, 922

[56] References Cited

U.S. PATENT DOCUMENTS

| | | | |
|---|---|---|---|
| 476,040 | 5/1892 | Curran | 441/60 |
| 1,767,651 | 6/1930 | Cuthbertson | 441/60 |
| 1,843,582 | 2/1932 | Schmitt | 441/60 |
| 2,013,520 | 9/1935 | McDermott | 441/60 |
| 3,789,447 | 2/1974 | Lavallee | 441/59 |

*Primary Examiner*—Joseph F. Peters, Jr.
*Assistant Examiner*—Edwin L. Swinehart
*Attorney, Agent, or Firm*—Woodard, Emhardt, Naughton, Moriarty & McNett

[57] ABSTRACT

A device and method for swimmers to enhance propulsion from the swimmer's kick. The device resists flexure of the swimmer's knees by providing a first band secured typically to the thigh, a second band secured typically to the lower leg, and a flexurally resistant member coupled to the first and second bands. By resisting knee flexure, the swimmer is forced to power a flutter kick with hip muscles rather than leg muscles, resulting in a generally more powerful and efficient flutter kick. In one embodiment, the bands secured to the legs may include Velcro ® for a snug ift. Also, the flexurally resistant member by comprise a graphite or fiberglass rod. A sliding member, such as a ring around the flexurally resistant member, may be provided with a line to prevent loss of a detached flexurally resistant member. Also, the flexurally resistant member may be snapped into fittings for quick assembly or release. The device may be attached to the lower leg by a swim fin adapted to be worn on the swimmer's foot. The device may be attached to the thigh by the upper band being attached to an underwater diver's suit pants. The flexurally resistant member may include first and second segments, and a locking mechanism for selectively having the member in a locked mode to resist bending or in an unlocked mode.

26 Claims, 8 Drawing Sheets

SWIMMER'S PROPULSION ENHANCER AND TRAINING DEVICE AND METHOD

REFERENCE TO RELATED APPLICATION

This application is a continuation-in-part of U.S. patent application Ser. No. 72,416, filed on July 13, 1987 by the same inventive entity, and entitled SWIMMER'S PROPULSION ENHANCER AND TRAINING DEVICE AND METHOD.

BACKGROUND OF THE INVENTION

This invention relates generally to an apparatus for swimmers, and more generally to an apparatus for resisting knee flexure during a swimmer's flutter kick.

A swimmer obtains motive propulsion through the water both from the swimmer's arms and legs. In many instances, such as competitive swimming, frictional drag caused by the legs is a significant concern, tending to slow a swimmer down. When utilizing a flutter kick, often streamlining the swimmer's flow through the water is as great of a concern as the amount of propulsion provided by the kicking legs. Such streamlining is enhanced by keeping the swimmer's legs relatively straight rather than bending them excessively at the knees. Excessive bending at the knees not only causes excessive frontal drag, but also may reduce the amount of kicking force properly available to the swimmer. Such improper kicks lead to inefficiencies and corresponding fatigue and reduction in swimmer performance. This is a concern not only to competitive swimmers racing for speed, but also to underwater swimmers, such as scuba divers, who will tire, and correspondingly utilize more of their precious compressed air if they do not optimize their swimming efficiency.

Several devices for swimmers have been designed. For example, several devices using a "check valve" approach to increasing swimmers' propulsion have been designed, such as U.S. Pat. No. 1,767,651 to Cuthbertson, U.S. Pat. No. 3,789,447 to Lavallee, U.S. Pat. No. 579,758 to Luce, and German Patent No. 178,223 to Schroder. The Cuthbertson and Luce devices disclose swimming appliances attached to the leg below the knee. The Lavallee device discloses a swimming accessory attached to the forearm of a swimmer, and the Schroder device shows a swimming appliance attached at the ankle and waist of the swimmer. These devices have hinged flaps which provide greater resistance when moved in the direction of movement of the power stroke than when moved in the direction of the return stroke. U.S. Pat. No. 3,835,493 to Grivna discloses another swimmer's appliance for providing resistance against water during a power stroke.

It is also desirable to train swimmers to use proper form in their flutter kicks. More specifically, it is desirable to have swimmers develop the use of their hip muscles for powering the flutter kick while de-emphasizing the use of leg muscles. U.S. Pat. No. 2,013,520 to McDermott discloses an apparatus for the use in instruction of swimming. The McDermott apparatus is a landbased apparatus having clasps to engage and hold the ankles and leg supports against which the swimmer's legs push to simulate water resistance. Such devices are used in training, and then during actual competition the swimmer performs without the apparatus, having improved form.

U.S. Pat. No. 1,909,259 to Feir discloses a stabilizing support device for bodies on water. The Feir device includes straps along the length of the supported person's legs and waist, and includes hinge "45 to permit free bending of the leg at the knee." Feir, col. 2, lines 32–33.

While the above devices provide certain advantages, none of them provide the same advantages in the same way as the present invention.

SUMMARY OF THE INVENTION

According to one embodiment, the present invention provides a device to be worn on a leg of a swimmer comprising: means for securing to the swimmer's thigh; means for securing to the swimmer's lower leg; a flexurally resistant member having a first segment coupled to the means for securing to the swimmer's thigh and having a second segment coupled to the means for securing to the swimmer's lower leg; and locking means for selectively providing a locked mode and an unlocked mode between the first segment and the second segment of the flexurally resistant member, wherein the locking means in the locked mode locks the first segment with respect to the second segment to resist a bending moment to provide elastic resistance by the flexurally resistant member to bending of the swimmer's knee, and wherein the locking means in the unlocked mode provides substantially free pivotable movement of the first segment with respect to the second segment to allow bending of the swimmer's knee.

The present invention also provides a method of resisting flexure of a swimmer's knees during a flutter kick comprising the steps of: securing to the swimmer's right thigh a right upper means for securing to the swimmer's right thigh; securing to the swimmer's right lower leg a right lower means for securing to the swimmer's right lower leg, the right lower means for securing having a right flexurally resistant member coupled thereto and coupled to the right upper means for securing, the right flexurally resistant member including a first segment, a second segment, and a right locking means for selectively providing a locked mode and an unlocked mode between the first segment and the second segment of the right flexurally resistant member, wherein the locking means in the locked mode locks the first segment with respect to the second segment to resist a bending moment to provide elastic resistance by the right flexurally resistant member to bending of the swimmer's knee, and wherein the locking means in the unlocked mode provides substantially free pivotable movement of the first segment with respect to the second segment to allow bending of the swimmer's knee; securing to the swimmer's left thigh a left upper means for securing to the swimmer's left thigh; securing to the swimmer's left lower leg a left lower means for securing to the swimmer's left lower leg, the left lower means for securing having a left flexurally resistant member coupled thereto and coupled to the left upper means for securing, the left flexurally resistant member including a third segment, a fourth segment, and a left locking means for selectively providing a locked mode and an unlocked mode between the third segment and the fourth segment of the left flexurally resistant member, wherein the locking means in the locked mode locks the third segment with respect to the fourth segment to resist a bending moment to provide elastic resistance by the left flexurally resistant member to bending of the swimmer's knee, and wherein the locking means in the unlocked mode provides substantially free pivotable movement of the third segment with respect to the fourth segment to allow bending of the swimmer's knee; and selectively changing the right and left locking means between the locked modes and the unlocked modes; and flutter kicking the swimmer's legs in water with the right and left locking means in the locked modes, wherein the kicking step includes the step of resisting knee flexure with the right flexurally resistant member and with the left flexurally resistant member.

The present invention also provides a device to be worn on the legs of a swimmer comprising: an underwater diver's suit pants having a right leg portion and a left leg portion; means for securing to the swimmer's right thigh attached to the right leg portion of the suit; means for securing to the swimmer's left thigh attached to the left leg portion of the suit; means for securing to the swimmer's right lower leg; means for securing to the swimmer's left lower leg; a right flexurally resistant member coupled to the means for securing to the swimmer's right thigh and to the means for securing to the swimmer's right lower leg, wherein the right flexurally resistant member provides resistance to bending of the swimmer's right knee; and a left flexurally resistant member coupled to the means for securing to the swimmer's left thigh and to the means for securing to the swimmer's left lower leg, wherein the left flexurally resistant member provides resistance to bending of the swimmer's left knee.

The present invention provides a device to be worn on a leg of a swimmer comprising: means for securing to the swimmer's right thigh; means for securing to the swimmer's left thigh; a first swim fin adapted to be worn on the swimmer's right foot; a second swim fin separate from the first swim fin and adapted to be worn on the swimmer's left foot; a right flexurally resistant member coupled to the means for securing to the swimmer's right thigh and to the first swim fin, wherein the right flexurally resistant member provides resistance to bending of the swimmer's right knee; and a left flexurally resistant member coupled to the means for securing to the swimmer's left thigh and to the second swim fin, wherein the left flexurally resistant member provides resistance to bending of the swimmer's left knee.

A general object of the present invention is to provide an improved swimmer's propulsion enhancer.

These and other objects of the present invention are disclosed in the specification.

DESCRIPTION OF THE PREFERRED EMBODIMENT

Figure 1:
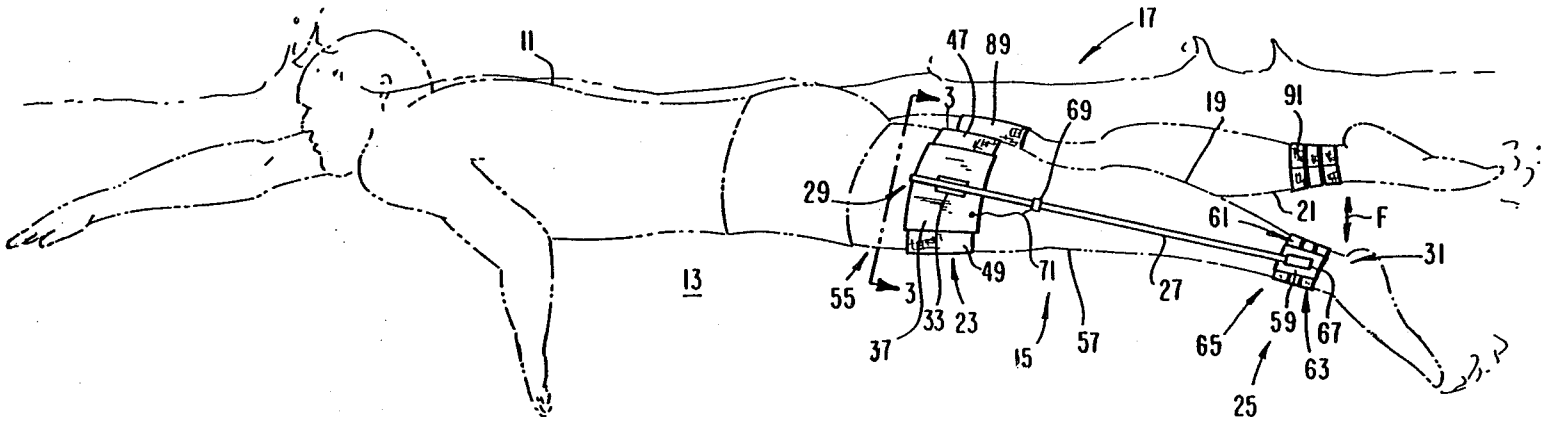
FIG. 1 is a side view of a swimmer wearing a pair of the swimmer's propulsion enhancer and training devices of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figures 2, 3, 4:
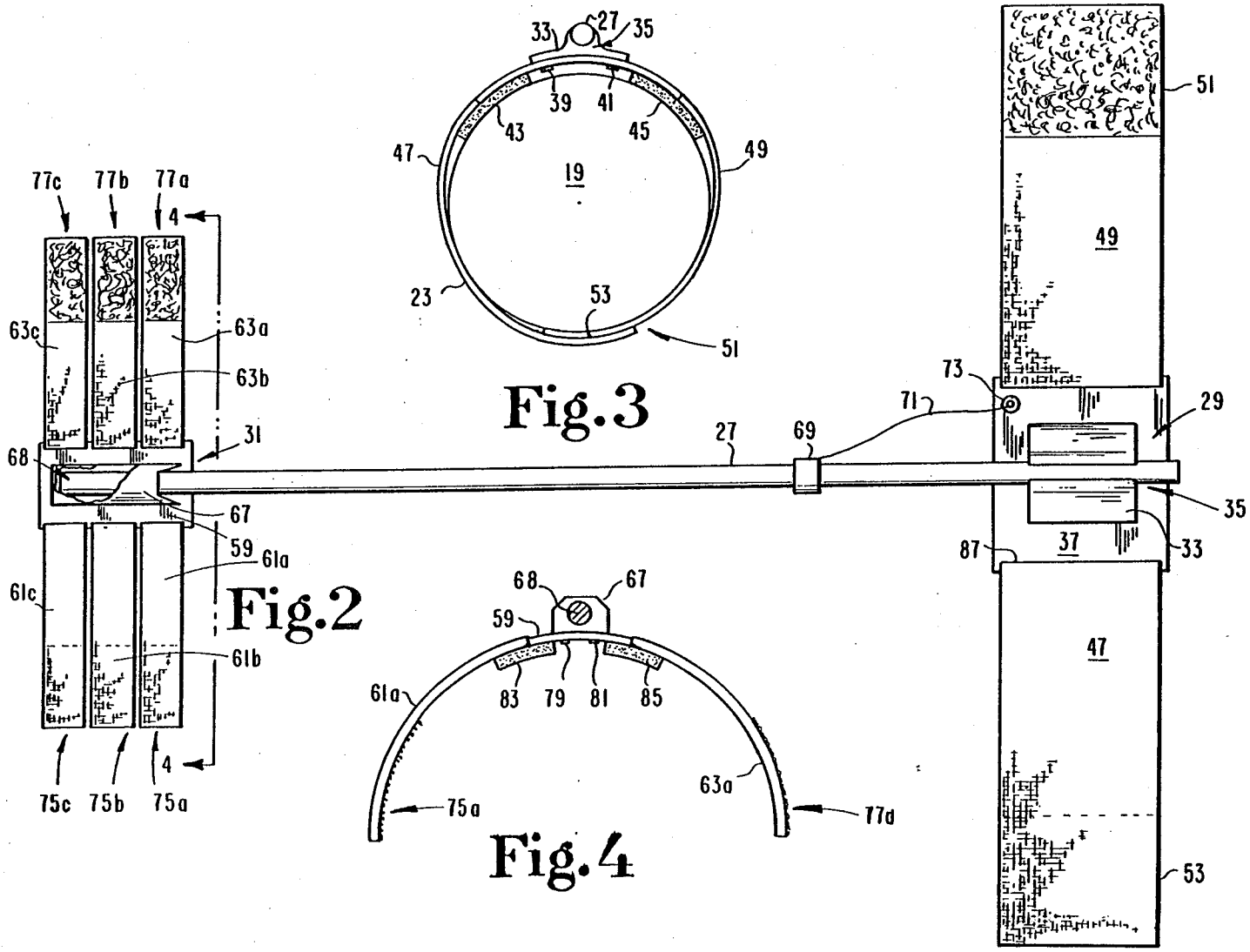
FIG. 2 is a partial cutaway side view of the device of FIG. 1 removed from the swimmer.
FIG. 3 is a front view of the device of FIG. 1 taken along lines 3—3.
FIG. 4 is a front view of the device of FIG. 2 taken along line 4—4.

Referring now to FIGS. 1, 2, 3 and 4, swimmer 11 is shown swimming in water 13 and wearing a pair of swimmer's propulsion enhancers 15 and 17 on the swimmer's left leg 19 and right leg 21, respectively. Swimmer 11 is shown doing a crawl stroke in which his legs are kicked upwardly and downwardly in a conventional flutter kick as shown by arrow "F". The swimmer's propulsion enhancer on the left leg includes left upper band 23 and left lower band 25 which are each coupled to flexurally resistant member 27. Flexurally resistant member 27 is typically an elongated rod made of graphite or fiberglass having a round cross section. The flexurally resistant member has an upper end 29 and a lower end 31. Upper end 29 is snap-fitted into longitudinal yoke 33 which is typically made of a flexible hard plastic or steel. As seen in FIG. 3, yoke 33 has a hemi-cylindrical crescent 35 cut therein to receive the circular cross section of flexurally resistant member 27. Due to the resiliency of yoke 33, flexurally resistant member 27 may be snapped in or out thereof in a matter of seconds. Such snap-in feature is not unlike the notches used to hold arrows in U.S. Pat. Nos. 2,746,658 to Freid and 4,073,328 to Franklin. Longitudinal yoke 33 is a fitting mounted to upper bracket body 37 by means, such as stainless steel screws 39 and 41. Alternatively, a fitting, such as yoke 33, may be cast homogeneously with bracket body 33. Upper bracket body 37 may be relatively rigid and conform generally to the outer profile of leg 19, while having some inherent flexibility to adapt to varying leg sizes. Upper body bracket 37 has foam padding 43 and 45 to provide comfort to the swimmer and to minimize wear or chafing from the upper bracket body or screws. Nylon straps 47 and 49 are flexible and, along with upper bracket body 37, make up left upper band 23 secured to leg 19. Nylon strap 49 includes Velcro® pile 51 which engages Velcro® hooks 53 on strap 47, causing nylon straps 47 and 49 to be coupled, thus encircling leg 19 with left upper band 23. In such way, left upper band 23 secures to thigh 55 of the swimmer above left knee 57 and below the swimmer's hip.

Left lower band 25 includes lower bracket body 59, and nylon straps 61 and 63. Nylon straps 61 and 63 have Velcro® pile and hooks substantially similar to Velcro pile 51 and Velcro® hooks 53 utilized in left upper band 23. Thus, left lower band 25 is secured around the lower leg 65 of the swimmer near the swimmer's left ankle. The lower leg is meant to define the swimmer's anatomy below knee 57, including the ankle and foot. Lower end 31 of flexurally resistant member 27 is mounted to lower bracket body by a fitting 67 having a longitudinal cup therein for receiving the end of member 27.

Lanyard retainer ring 69 encircles flexurally resistant member 27 and is attached to upper body bracket 37 by Lanyard line 71 and grommet fitting 73. The ring and line act to prevent member 27 from being lost in the water if member 27 becomes detached from its fittings.

As can be seen in FIG. 2, nylon straps 61 and 63 actually comprise three individual nylon straps each, 61*a*, 61*b*, 61*c*, 63*a*, 63*b*, and 63*c*. There is a corresponding Velcro ® hook 75*a*, 75*b*, and 75*c*, and Velcro ® pile 77*a*, 77*b*, and 77*c* which engage each other to hold their respective nylon straps snugly around the swimmer's lower leg.

Note that the nylon straps, such as nylon strap 47, is coupled to upper bracket body 37 at longitudinal slot 87 (FIG. 2). Other nylon straps are coupled to their corresponding bracket bodies at similar longitudinal slots.

Longitudinal cup 68 is shown in FIG. 2, by fitting 67 being partially cut away. Longitudinal cup 68 receives lower end 31 of flexurally resistant member 27.

FIG. 4 shows a front view of left lower band 25 separated from the lower leg of the swimmer. Flexurally resistant member 27 is shown in section in the longitudinal cup 68 in fitting 67. Stainless steel screws 79 and 81 hold fitting 67 to lower bracket body 59. Foam pads 83 and 85 provide comfort and an improved fit on the lower leg of the swimmer.

In FIG. 1, right upper band 89 is substantially similar to left upper band 23 except it is mounted on the right thigh of the swimmer. Also, right lower band 91 is likewise similar to left lower band 25 except that it is worn on the swimmer's right lower leg. There is a flexurally resistant member (not shown) coupling right upper band 89 with right lower band 91, substantially similar to the way that member 27 couples its respective bands.

Figure 5:
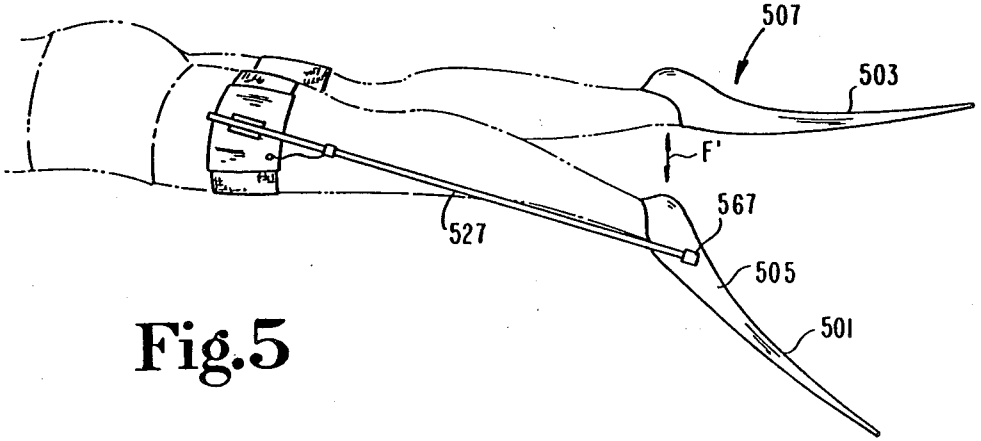
FIG. 5 is a side view of a swimmer wearing an alternative embodiment of the swimmer's propulsion enhancer of the present invention.

Referring now to FIG. 5, an alternative embodiment of the present invention is shown utilizing swim fins 501 and 503. The reference numbers shown in FIG. 5 begin with a "500 series" prefix, but otherwise denote substantially similar structure as previously discussed with FIGS. 1 through 4. Swim fin 501 has an outside edge 505, and swim fin 503 has an outside edge 507. A fitting, such as fitting 567, is mounted to outside edge 505, rather than lower bracket body 59 as shown in FIGS. 1, 2 and 4. Flexurally resistant member 527 is substantially the same as member 27 previously discussed, except that member 527 is longer and is mounted in a longitudinal cup in fitting 567. The swim fins are worn on the swimmer's feet, as is conventionally known, and provide additional thrust for the swimmer during a flutter kick, shown as F'.

To use the present invention, the swimmer first secures the right upper band to his right thigh, secures the right lower band to his right lower leg, secures the left upper band to his left thigh, secures the left lower band to his left lower leg, and then installs the flexurally resistant members for each leg into the bands. This is accomplished by placing the lower end of the flexurally resistant member in the longitudinal cup of the fitting mounted to the lower band and then snapping the flexurally resistant member into the longitudinal yoke mounted to the upper band for each leg. The swimmer then proceeds to swim in water, using a flutter kick as known in the art of swimming. During the flutter kick, the left and right legs of the swimmer are moved upwardly and downwardly as shown by arrow "F" in FIG. 1, and arrow "F'" in FIG. 5. The flexurally resistant members resist knee flexure by the swimmer, requiring the swimmer to power the flutter kick using primarily hip muscles rather than leg muscles. During the flutter kick, some flexure may occur, elastically bending the flexurally resistant member (typically a graphite or fiberglass rod). This bending creates potential spring energy in the flexurally resistant rod, which later may be converted to potential energy during the power downstroke in a flutter kick as the rod straightens out.

Various flexurally resistant members with varying degrees of stiffness may be provided. This is accomplished by using various cross sectional moments of inertia, as accomplished by varying cross sectional diameter, as well as using materials with a different modulus of elasticity. In this way, the swimmer may vary the resistivity to knee flexure, allowing the swimmer to progressively work up to greater development of the hip muscles properly used for a flutter kick. This is especially useful in training of a competitive swimmer. The swimmer may train using the present invention by initially using a more flexible flexurally resistant member. Over time, the swimmer progresses by training with stiffer flexurally resistant members, developing stronger hip muscles for the flutter kick. During competition, the present invention is removed, the swimmer having developed improved form and strength by use of the present invention. The improved form of the flutter kick should include a swiveling action of the hips through the water, resulting in a faster and more efficient stroke.

Finally, the specific gravity of the device of the present invention may vary, but it is believed that in the best mode, the specific gravity should be approximately the same as that of the water in which the device is to be used.

Referring now to FIGS. 6A, 6B, 6C, 7A, 7B and 7C, a second alternative embodiment of the present invention is shown. The reference numbers shown in these figures begin with a "600 series" prefix, but otherwise denote substantially similar structure as previously discussed with FIGS. 1–5. There are two primary features added by this second alternative embodiment. The first is the inclusion of a locking means 672 on flexurally resistant member 627. The second is that the means for attaching to the swimmer's leg, such as right upper band 624 and right lower band 626 may be attached to the leg portion of an underwater diver's suit pants, such as the pants of a wetsuit.

Figure 6C:
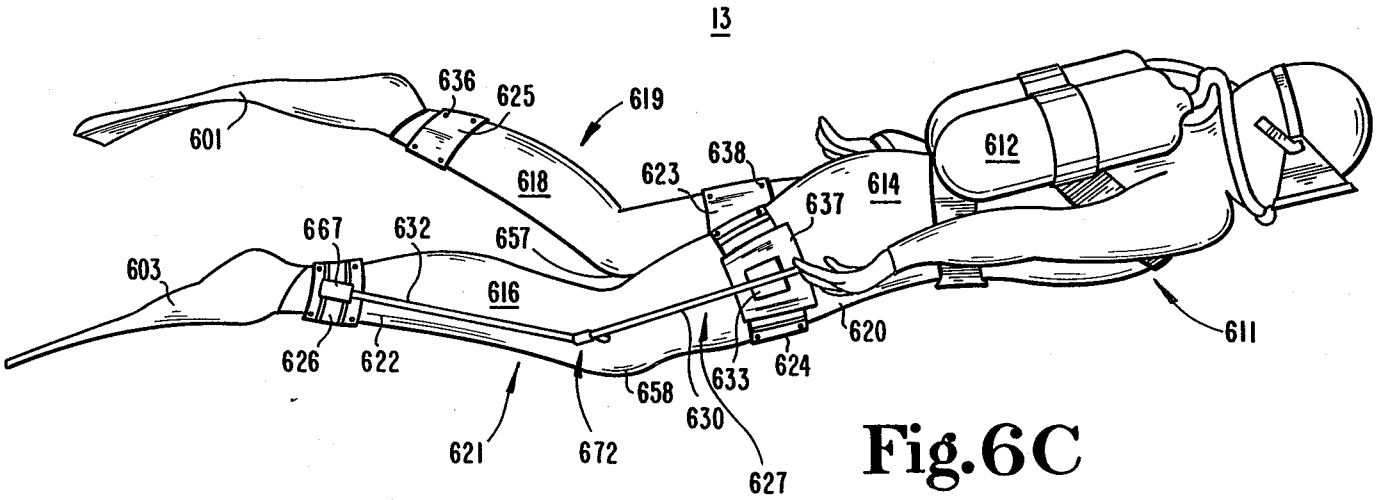
FIG. 6C is a side view of the swimmer of FIG. 6A swimming with the propulsion enhancer of the present invention in an unlocked mode.
Figure 6A:
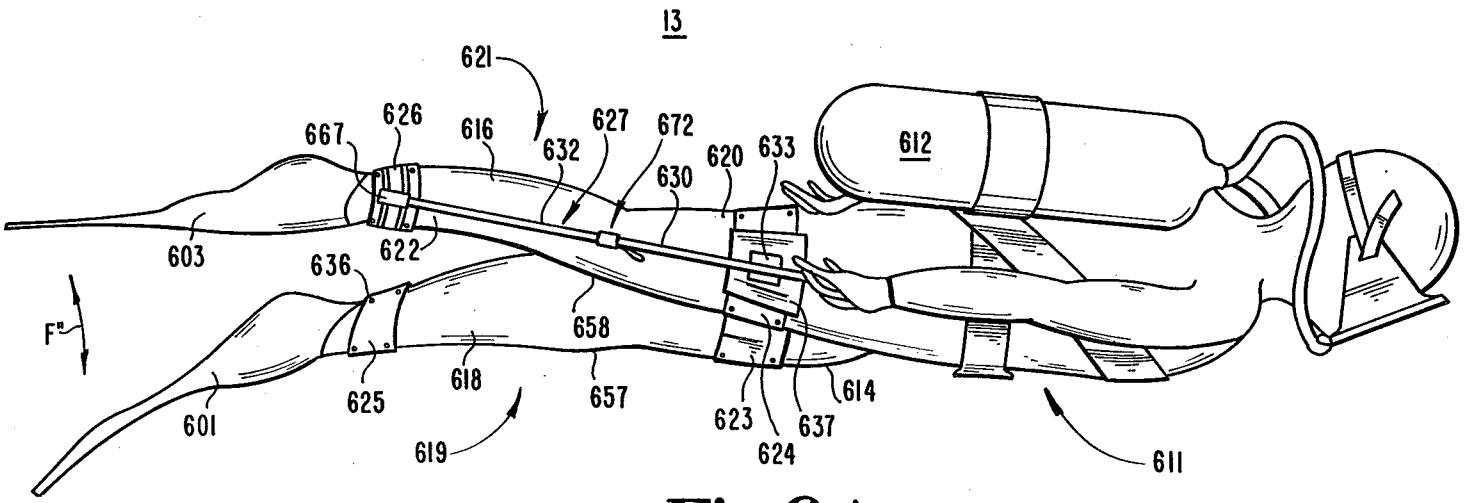
FIG. 6A is a side view of a swimmer wearing a second alternative embodiment of the swimmer's propulsion enhancer of the present invention in a locked mode.
Figure 6B:
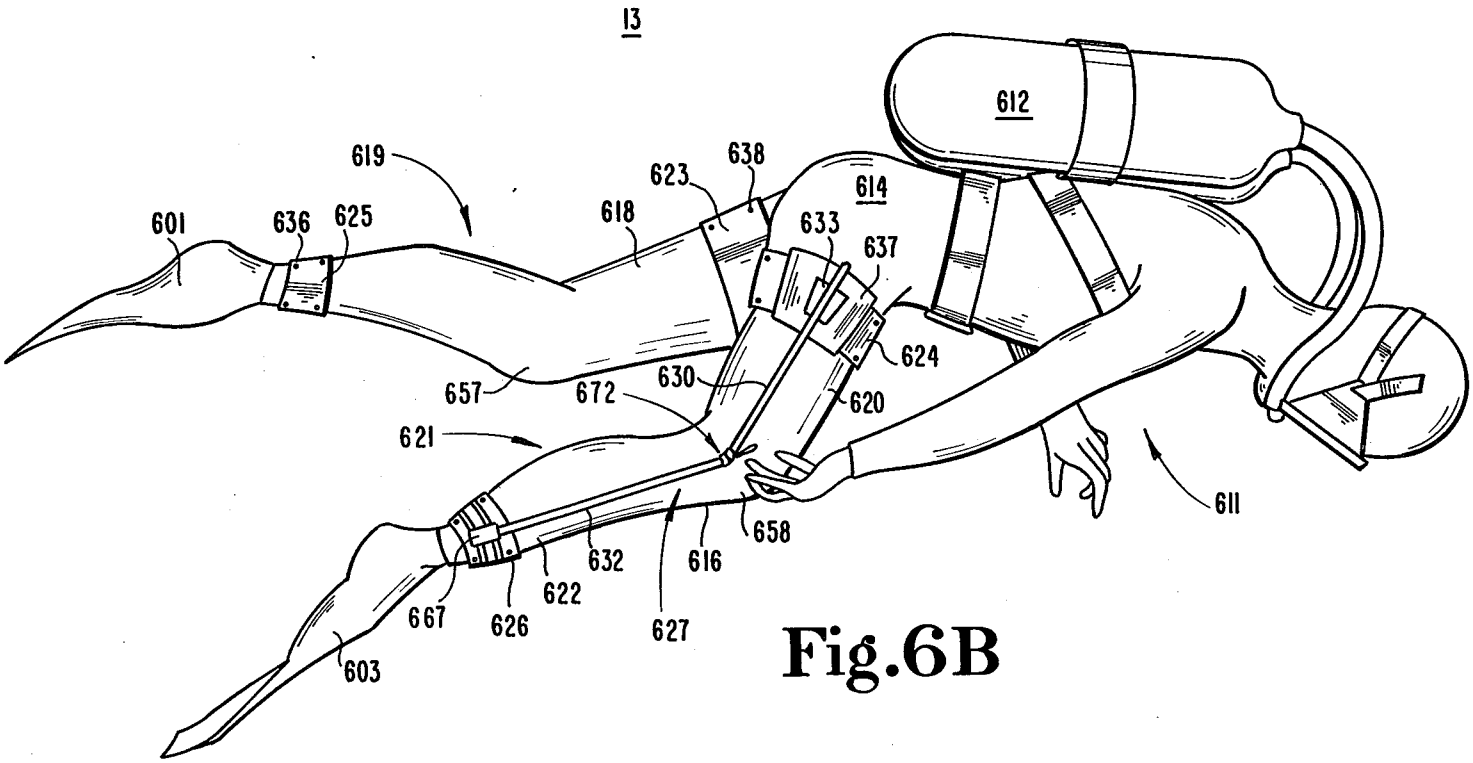
FIG. 6B is a side view of the swimmer of FIG. 6A changing the swimmer's propulsion enhancer between a locked and an unlocked mode.

In FIG. 6A, 6B and 6C, swimmer 611 is shown in water 13. Swimmer 611 is a scuba diver wearing scuba tanks, such as scuba tank 612, along with the other standard scuba equipment such as a regulator and a dive mask. The swimmer is also shown wearing an underwater diver's suit, such as a wetsuit or a drysuit, which are typically made of an elastomeric material. Such suit includes underwater diver's suit pants 614 which has right leg portion 616 and left leg portion 618 typical of such pants. Illustrated diver's suit pants 614 include long legs with thigh portions and lower leg portions such as thigh portion 620 and lower leg portion 622.

Optionally, diver's suit pants with short legs may be utilized.

Right upper band 624 is attached to thigh portion 620 of right leg portion 616 of the diver's suit pants. Such attachment may be accomplished with a variety of structures, but the illustrated embodiment utilizes attaching rivits to attach the bands to the diver's suit pants. Such rivits are shown, for example as attached rivet 638 (See FIG. 6B, FIG. 6C) attaching left upper band 623 to left leg portion 618. Attaching rivit 636 similarily attaches left lower band 625 to the lower leg portion of left leg portion 618. Right lower band 626 and band 624 may be similarily attached with attaching rivits as illustrated. Other mechanisms for attachment may include adhesives or may include integrally molding the bands into the elastomeric material making up the diver's suit pants. Upper bracket body 637 is shown attached to right upper band 624 and having fitting 633 attached thereto. Similarily, right lower band 626 has fitting 667 attached. Right lower strap 626 is attached to lower long portion 622 of the diver's suit. The use and design of such bracket bodies and fittings may vary according to design.

A pair of flexurally resistant members, such as flexurally resistant member 627, are coupled to the upper and lower bands attached to the swimmer's upper and lower legs as described above. Specifically, flexurally resistant member 627 is attached to such bands by fitting 633 and by fitting 667 on right leg 621, and a similar such flexurally resistant member (not shown) is attached to the bands on left leg 619. Flexurally resistant member 627 includes at least two segments, segment 630 and segment 632. Segment 630 runs along the upper leg where segment 632 runs along the lower leg. Each of these segments is preferably a rod or shaft, and is preferably made of a flexible material such as graphite or fiberglass as described above. Segment 630 and segment 632 are attached together at their ends by lock mechanism 672. On the left leg there is a corresponding flexurally resistant member including a first segment and a second segment and a locking mechanism which, in the preferred embodiment, is the same as flexurally resistant member 627 and lock mechanism 672 described in conjunction with the right leg.

Lock mechanism 672 may be selectively locked and unlocked between a locked mode (see FIG. 6A) and an unlocked mode (see FIG. 6C). In an unlocked mode, lock mechanism 672 provides substantially free pivotable movement of segment 630 with respect to segment 632 to allow bending of the swimmer's knee. Accordingly, preferably lock mechanism 672 is positioned near right knee 658, and a corresponding lock mechanism on the left leg is located near left knee 657. Such pivotable movement may be provided by a hinge with a pivotable axis oriented substantially in alignment with the axis on which the swimmer's knees pivot.

Figure 7A:
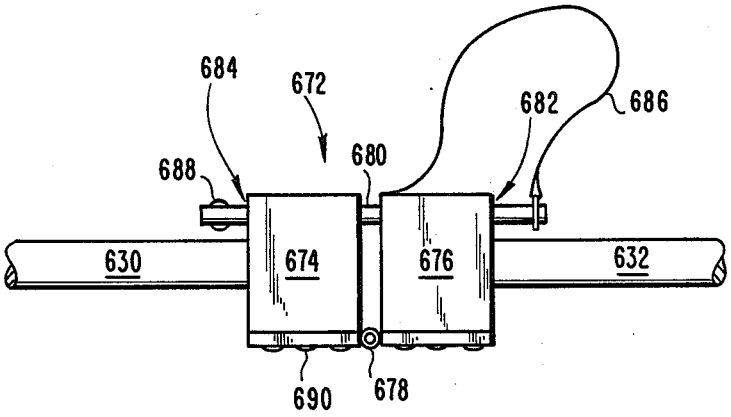
FIG. 7A is a side detail view of one embodiment of a locking means used in the present invention.
Figure 7B:
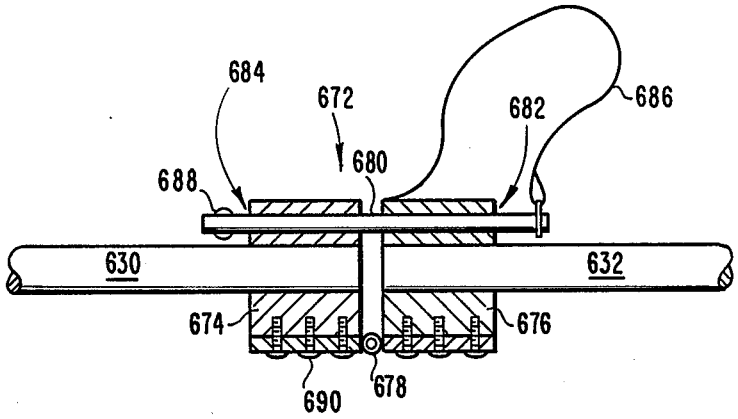
FIG. 7B is a partially cutaway side detail view of the locking means of FIG. 7A in a locked mode.

The existence of lock mechanism 672 allows for greater latitude in the use of the present invention. By selectively locking or unlocking flexurally resistant member, the swimmer may utilize the propulsion enhancing characteristics of the present invention (locked mode) or may enjoy greater movement in his knees (unlocked mode) when required. For example, the unlocked mode with its greater mobility in the knees may be useful when the swimmer is negotiating tight corners in an underwater cave or when the swimmer is walking around on land while wearing the present invention. Thus, in the locked mode, lock mechanism 672 locks segment 630 with respect to segment 632 to resist a bending moment to provide elastic resistance by flexurally resistant member 627 to bending of the swimmer's knees, and in the unlocked mode to allow substantially free pivotal movement of the swimmer's knee. Such function, in combination with the other features of the present invention, may be provided by a variety of locking mechanisms of various mechanical design. However, one suitable design for such lock mechanism is illustrated in FIG. 7A, 7B and 7C.

Swim fin 601 and swim fin 603 are standard swim fins well known to skin divers and scuba divers and are worn on the foot. Although the embodiment illustrated in FIG. 6A, 6B and 6C illustrate the lower end of flexurally resistant member 627 coupled to the swimmer's ankle, the present invention with diver's suit pants and/or locking mechanism 672 and/or other features may also be utilized by attaching the flexurally resistant member to its respective swim fin, such as swim fin 603 and swim fin 601 in a manner disclosed in FIG. 5 above.

Lock mechanism 672 may comprise hinge body 674, hinge body 676, hinge 678 and pin 680. Pin 680 is movable with respect to hinge body 674 and hinge body 676 and is disposed in hole 684, and hole 682 located in the hinge bodies respectively. Segment 630 is attached to hinge body 674. Segment 632 is attached to hinge body 676. Adhesives or other means may be used for such attachment or the segment and hinge body may be integrally formed. Hinge 678 pivotably attaches hinge body 674 and hinge body 676 and may be held thereto by screws, such as screw 690.

Figure 7C:
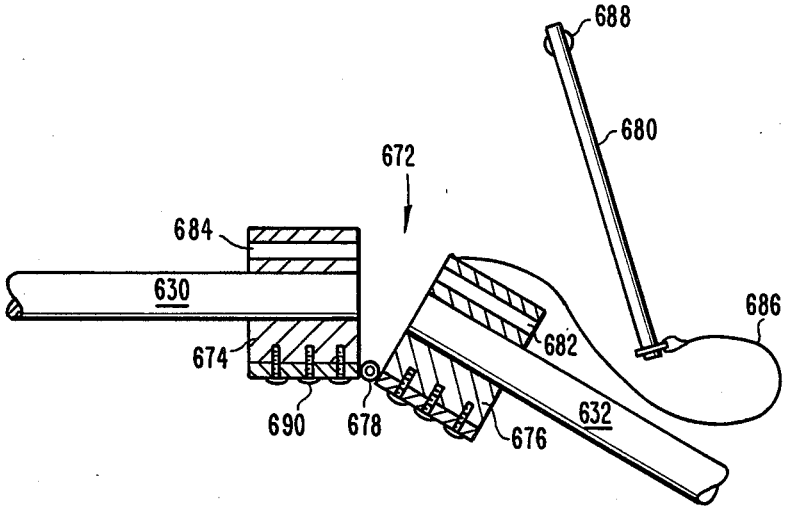
FIG. 7C is a partially cutaway side detail view of the locking means of FIG. 7A in an unlocked mode.

Pin 680 acts as a release member in lock mechanism 672 in that it may be longitudinally withdrawn from hole 682 and hole 684 to cause an unlocked mode (see FIG. 7C). Retaining cable 686 is attached to one end of pin 680 and to lock mechanism 672 to prevent pin 680 from being lost underwater when lock mechanism 672 is an unlocked mode. At the opposite end of pin 680, detent 688 is provided to reduce the likelihood of accidental longitudinal withdraw of pin 680 from hole 684. Detent 688 may be a leaf spring structure which is collapsible within pin 680 upon sufficient application of longitudinal withdrawal force to pin 680, causing the opening of hole 684 to bear down on detent 680 allowing the withdrawal of the pin.

FIG. 7A and FIG. 7B show lock mechanism 672 in a locked mode. FIG. 7C shows lock mechanism 672 in an unlocked mode, with pin 680 withdrawn from hole 682 and hole 684 and with hinge 678 pivoted on its hinge axis. As illustrated in FIG. 7A and 7B, pin 680 in position with respect to hinge 678 provide a resistance against a bending moment between segment 630 and segment 632. As illustrated, hole 682 and 684 are elongated bores through their respective hinge body, and accordingly do not allow significant slippage of pin 680 therein with respect to hinge 678.

The method of using the device illustrated in FIGS. 6A, 6B and 6C is essentially the same as that described with the other embodiments. Conventional flutter kicking F″ (see FIG. 6A) in a locked mode are preferred after the device of the present invention has been secured to the swimmer. Such securing to the swimmer's right and left thigh comprise a step of inserting the swimmer's right leg through right leg portion 616 of the diver's suit and inserting the swimmer's left leg through left leg portion 618 of the diver's suit so that the diver's suit pants 614 are worn by and secured to the swimmer. Such technique, in the illustrated embodiment, would likewise secure the device of the present invention to the swimmer's right lower leg and left lower leg since band 626 and band 625 are attached to the swimmer's suit pants 614. Alternatively, the device of the present invention may be secured to the swimmer's lower leg by putting swim fins on the swimmer's feet and attaching the flexurally resistant members respectively thereto. Flutter kicking F″ include flutter kicking swim fin 601 and swim fin 603 with respect to each other.

The swimmer may selectively change (see FIG. 6B) the locking mechanism 672 between a locked mode (see FIGS. 6A, 7A and 7B) and an unlocked mode (see FIGS. 6C, 7C).

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device to be worn on a leg of a swimmer comprising:

means for securing to the swimmer's thigh;

means for securing to the swimmer's lower leg;

a flexurally resistant member having a first segment coupled to said means for securing to the swimmer's thigh and having a second segment coupled to said means for securing to the swimmer's lower leg; and locking means for selectively providing a locked mode and an unlocked mode between said first segment and said second segment of said flexurally resistant member, wherein the locking means in the locked mode locks said first segment with respect to said second segment to resist a bending moment to provide elastic resistance by said flexurally resistant member to bending of the swimmer's knee, and wherein said locking means in said unlocked mode provides substantially free pivotable movement of said first segment with respect to said second segment to allow bending of the swimmer's knee.

2. The device of claim 1 wherein said locking means includes a first hinge body affixed to said first segment, and further includes a second hinge body affixed to said second segment and pivotably connected to said first hinge body by a hinge, and further includes a release member which is movable with respect to said first and second hinge body between said locked mode and said unlocked mode.

3. The device of claim 2 wherein said release member comprises a pin insertable through a first hole in said first hinge body and insertable through a second hole in said second hinge body, wherein said pin has a retaining cable attached thereto and wherein said pin includes a detent member at one end of said pin to retain said pin in said first and second holes when said locking means is in said locked mode.

4. The device of claim 3 wherein said locking means is located along said flexurally resistant member adjacent the swimmer's knee.

5. The device of claim 4 and further comprising an underwater diver's suit pants including a thigh portion, and wherein said means for securing to the swimmer's thigh is attached to said thigh portion of said diver's suit pants.

6. The device of claim 4 wherein said means for securing to the swimmer's thigh further includes flexible strap and a hook and pile closure for securing said flexible strap to the thigh.

7. The device of claim 5 wherein said flexurally resistant member includes a graphite rod.

8. The device of claim 5 wherein said flexurally resistant member includes a fiberglass rod.

9. The device of claim 5 wherein said diver's suit pants include an ankle portion, and wherein said means for securing to the swimmer's lower leg is attached to said ankle portion of said diver's suit pants.

10. The device of claim 5 wherein said means for securing to the swimmer's lower leg comprises a swim fin adapted to be worn on the swimmer's foot.

11. The device of claim 1 wherein said locking means is located along said flexurally resistant member adjacent the swimmer's knee.

12. The device of claim 1 and further comprising an underwater diver's suit pants including a thigh portion, and wherein said means for securing to the swimmer's thigh is attached to said thigh portion of said diver's suit pants.

13. The device of claim 1 wherein said means for securing to the swimmer's thigh further includes flexible strap and a hook and pile closure for securing said flexible strap to the thigh.

14. The device of claim 1 wherein said flexurally resistant member includes a graphite rod.

15. The device of claim 1 wherein said flexurally resistant member includes a fiberglass rod.

16. The device of claim 1 wherein said means for securing to the swimmer's lower leg comprises a swim fin adapted to be worn on the swimmer's foot.

17. A method of resisting flexure of a swimmer's knees during a flutter kick comprising the steps of:

securing to the swimmer's right thigh a right upper means for securing to the swimmer's right thigh;

securing to the swimmer's right lower leg a right lower means for securing to the swimmer's right lower leg, said right lower means for securing having a right flexurally resistant member coupled thereto and coupled to said right upper means for securing, said right flexurally resistant member including a first segment, a second segment, and a right locking means for selectively providing a locked mode and an unlocked mode between said first segment and said second segment of said right flexurally resistant member, wherein said locking means in said locked mode locks said first segment with respect to said second segment to resist a bending moment to provide elastic resistance by said right flexurally resistant member to bending of the swimmer's knee, and wherein said locking means in said unlocked mode provides substantially free pivotable movement of said first segment with respect to said second segment to allow bending of the swimmer's knee;

securing to the swimmer's left thigh a left upper means for securing to the swimmer's left thigh;

securing to the swimmer's left lower leg a left lower means for securing to the swimmer's left lower leg, said left lower means for securing having a left flexurally resistant member coupled thereto and coupled to said left upper means for securing, said left flexurally resistant member including a third segment, a fourth segment, and a left locking means for selectively providing a locked mode and an unlocked mode between said third segment and said fourth segment of said left flexurally resistant member, wherein said locking means in said locked mode locks said third segment with respect to said fourth segment to resist a bending moment to provide elastic resistance by said left flexurally resistant member to bending of the swimmer's knee, and wherein said locking means in said unlocked mode provides substantially free pivotable movement of said third segment with respect to said fourth segment to allow bending of the swimmer's knee; and selectively changing said right and left locking means between said locked modes and said unlocked modes; and flutter kicking the swimmer's legs in water with said right and left locking means in said locked modes, wherein said kicking step includes the step of resisting knee flexure with said right flexurally resistant member and with said left flexurally resistant member.

18. The method of claim 17 wherein at least one of said flexurally resistant members includes a graphite rod, and said resisting step includes the step of elastically bending said graphite rod.

19. The method of claim 17 wherein at least one of said flexurally resistant members includes a fiberglass rod, and said resisting step includes the step of elastically bending said fiberglass rod.

20. The method of claim 17 wherein said means for securing to the swimmer's right thigh and said means for securing to the swimmer's left thigh are attached to an underwater diver's suit pants having a right leg portion and a left leg portion, and further comprising the step of inserting the swimmer's right leg through said right leg portion and inserting the swimmer's left leg through said left leg portion, wherein said diver's suit pants are worn by and secured to the swimmer.

21. The method of claim 17 wherein said means for securing to the swimmer's right lower leg comprises a first swim fin adapted to be worn on the swimmer's right foot and wherein said means for securing to the swimmer's left lower leg comprises a second swim fin adapted to be worn on the swimmer's left foot, and wherein said step of flutter kicking comprises the step of flutter kicking said first and second swim fins.

22. The method of claim 20 wherein said means for securing to the swimmer's right lower leg comprises a first swim fin adapted to be worn on the swimmer's right foot and wherein said means for securing to the swimmer's left lower leg comprises a second swim fin adapted to be worn on the swimmer's left foot, and wherein said step of flutter kicking comprises the step of flutter kicking said first and second swim fins.

23. A device to be worn on the legs of a swimmer comprising:

an underwater diver's suit pants having a right leg portion and a left leg portion;

means for securing to the swimmer's right thigh attached to said right leg portion of said suit;

means for securing to the swimmer's left thigh attached to said left leg portion of said suit;

means for securing to the swimmer's right lower leg;

means for securing to the swimmer's left lower leg;

a right flexurally resistant member coupled to said means for securing to the swimmer's right thigh and to said means for securing to the swimmer's right lower leg, wherein said right flexurally resistant member provides resistance to bending of the swimmer's right knee; and a left flexurally resistant member coupled to said means for securing to the swimmer's left thigh and to said means for securing to the swimmer's left lower leg, wherein said left flexurally resistant member provides resistance to bending of the swimmer's left knee.

24. The device of claim 23 wherein said means for securing to the swimmer's right lower leg is attached to said right leg portion of said diver's suit pants, and wherein said means for securing to the swimmer's left lower leg is attached to said left leg portion of said diver's suit pants.

25. The device of claim 23 wherein said means for securing to the swimmer's right lower leg comprises a first swim fin adapted to be worn on the swimmer's right foot, and wherein said means for securing to the swimmer's left lower leg comprises a second swim fin adapted to be worn on the swimmer's left foot.

26. A device to be worn on a leg of a swimmer comprising:

means for securing to the swimmer's right thigh;

means for securing to the swimmer's left thigh;

a first swim fin adapted to be worn on the swimmer's right foot;

a second swim fin separate from said first swim fin and adapted to be worn on the swimmer's left foot;

a right flexurally resistant member coupled to said means for securing to the swimmer's right thigh and to said first swim fin, wherein said right flexurally resistant member provides resistance to bending of the swimmer's right knee; and a left flexurally resistant member coupled to said means for securing to the swimmer's left thigh and to said second swim fin, wherein said left flexurally resistant member provides resistance to bending of the swimmer's left knee.

* * * * *